US009877552B2

(12) United States Patent
Petrosyan

(10) Patent No.: US 9,877,552 B2
(45) Date of Patent: Jan. 30, 2018

(54) JEWELRY WITH INTERCHANGABLE JEWEL

(71) Applicant: Ishkhan Petrosyan, Los Angeles, CA (US)

(72) Inventor: Ishkhan Petrosyan, Los Angeles, CA (US)

( * ) Notice: Subject to any disclaimer, the term of this patent is extended or adjusted under 35 U.S.C. 154(b) by 0 days.

(21) Appl. No.: 15/092,590

(22) Filed: Apr. 6, 2016

(65) Prior Publication Data

US 2017/0020247 A1 Jan. 26, 2017

Related U.S. Application Data

(60) Provisional application No. 62/143,656, filed on Apr. 6, 2015.

(51) Int. Cl.

| | |
|---|---|
| ***A44C 17/00*** | (2006.01) |
| ***A44C 17/02*** | (2006.01) |
| ***A44C 9/00*** | (2006.01) |

(52) U.S. Cl.

CPC ..... *A44C 17/0233* (2013.01); *A44C 9/0053* (2013.01)

(58) Field of Classification Search

CPC ..... A44C 17/0208; A44C 9/00; A44C 25/001; A44C 17/0233; A44C 9/0053; A44D 2203/00

USPC ..... 63/40, 29.2, 900

See application file for complete search history.

(56) References Cited

U.S. PATENT DOCUMENTS

| | | | | |
|---|---|---|---|---|
| 1,568,924 | A * | 1/1926 | Shatkin | A44C 17/0233 63/29.1 |
| 5,077,989 | A | 1/1992 | Dillabaugh | |
| 7,222,503 | B2 | 5/2007 | Golove | |
| 7,409,837 | B2 | 8/2008 | Smith | |
| 8,596,090 | B1 | 12/2013 | Smith | |
| 2004/0237587 | A1 | 12/2004 | Dubnicka | |
| 2006/0032270 | A1 | 2/2006 | Doyno | |
| 2008/0289363 | A1 | 11/2008 | Langford | |
| 2009/0100869 | A1 | 4/2009 | Golove et al. | |
| 2013/0233017 | A1 | 9/2013 | Nevatia | |

FOREIGN PATENT DOCUMENTS

| | | |
|---|---|---|
| FR | 1535640 | 8/1968 |
| WO | WO 2008/053263 A1 | 5/2008 |

* cited by examiner

*Primary Examiner* — Jack W Lavinder
(74) *Attorney, Agent, or Firm* — Thorpe North & Western LLP

(57) ABSTRACT

A jewelry device adapted to have interchangeable jewels includes a decorative setting, such as a ring, earrings, or pendant, for displaying a jewel. The decorative setting has a jewel receiving space to receive and hold a jewel housing having a jewel secured therein when the jewel housing is inserted into the jewel receiving space. A fastener held by the decorative setting is adapted to attach to and hold the jewel housing with jewel secured therein when the jewel housing is inserted into the jewel receiving space of the decorative setting. The fastener may be inseparably attached to the decorative setting so it is not separated and lost when changing jewels. Further, the jewel receiving space and the jewel housing may have interlocking portions to prevent relative rotational movement between the jewel housing and the decorative setting when the decorative setting is received in the jewel receiving space.

19 Claims, 9 Drawing Sheets

JEWELRY WITH INTERCHANGABLE JEWEL

PRIORITY CLAIM

Priority is claimed to U.S. Provisional Patent Application Ser. No. 62/143,656 filed Apr. 6, 2015, which is hereby incorporated herein by reference in its entirety.

BACKGROUND

Field of the Invention

The present invention relates to jewelry with interchangeable jewels.

Related Art

Precious jewels such as diamonds, rubies, emeralds, etc. for jewelry, such as rings, earrings, and pendants, which include such precious jewels, can be very expensive. With such jewelry, the expensive jewel is securely mounted in a setting such as the ring, earrings, or pendant. The setting is a permanent part of the jewelry and will usually be made of a precious metal such as gold, silver, or platinum. In such case, the jewel can only be worn with the setting in which it is permanently mounted, such as in a gold ring.

People like to wear jewelry that goes with cloths that the person is wearing and with the event at which the jewelry is being worn. While a jewel, such as a diamond, may go with many different outfits, the particular setting for the jewel may only go with a limited number of outfits. For example, a silver setting may go with some outfits while a gold setting may go with other outfits. Further, while a ring may want to be worn on certain occasions and with certain outfits, a pendant or earrings may want to be worn for other occasions and with different outfits. In addition, some settings may go with certain outfits for certain occasions, but the particular jewel in the setting may not. It would be desirable to be able to wear a favorite jewel in a number of different settings depending upon the outfit worn and the occasion, or to wear a favorite setting with different jewels depending upon the outfit worn and the occasion.

There are several lines of interchangeable jewelry currently commercially available which provide a number of rings, earrings, pendants, bracelets, and necklaces along with a number of inserts to be used interchangeably with the rings, earrings, pendants, bracelets, and necklaces, see for example Kameleon Jewelery (kameleonjewelry.com) and Ginger Snaps (www.gingersnapsjewelry.com). The inserts are pushed into a receiving opening in the rings, earrings, pendants, bracelets, and necklaces and pushed out when it is desired to replace the insert with a different insert. There are also commercially available rings having a threaded shank or stud extending therefrom to receive various interchangeable decorative items, such as beads and glass designs, screwed onto the shank or stud (for examples see www.etsy.com/market/interchangeable_ring). A pendant with similar threaded shank or stud extending therefrom is also available. While these jewelry systems provide jewelry with interchangeable decorative inserts, the inserts available do not include large jewels or expensive jewels and the jewelry produced with these items is not the same as traditional jewelry displaying large and/or expensive jewels. Currently available interchangeable jewelry systems do not provide the safety and security for the interchangeable items needed in order to include expensive and/or large jewels in such items.

Various applications for patent have been filed and patents issued covering interchangeable jewelry systems, see, for example, US 2013/0233017, US 2009/0100869, US 2006/0032270, US 2008/0289363, US 2004/0237587, WO 2008/053263, and French Patent No. 1,535,640. However, there remains a need for an easy to use system for interchanging jewels in settings such as rings, earrings, pendants, etc. which can securely hold such jewels in such settings, and can securely mount large and/or expensive jewels in such settings.

SUMMARY OF THE INVENTION

According to the invention, a decorative setting, such as in the form of a ring, earrings, pendant necklace, bracelet pin, cuff links, or other items of jewelry, has a jewel receiving space in a display side thereof for interchangeably receiving a jewel housing with a jewel, such as a diamond, securely housed therein. The decorative setting includes a fastener adapted to cooperate with the jewel housing when the jewel housing is received in the jewel receiving space of the decorative setting to securely mount the jewel housing in the decorative setting. The fastener may be a screw held by the decorative setting to be screwed into a receiving threaded opening in the jewel housing when the jewel housing is received in the jewel receiving space. The screw may have a screw head which includes a retractable tab for helping a user screw the screw into the threaded opening in the jewel housing. In addition, an interlock may be provided to prevent relative motion, such as rotation, of the jewel housing with respect to the decorative setting. The interlock may include one or more grooves in the jewel receiving space of the decorative setting adapted to receive one or more mating projections from the jewel housing.

The fastener can advantageously be inseparably held in the decorative setting so that it remains with the decorative setting and is not separated therefrom to become lost during the interchange of jewel housings in the decorative setting or during storage of the decorative setting without a jewel housing therein. The fastener may be a screw extending through the decorative setting from a back side into the jewel receiving space and having a head with a shank that extends from the head through the decorative setting into the jewel receiving space and having a flange attached to the shank in the jewel receiving space to prevent the screw from separating from the decorative setting. The flange may be movably attached to the shank to allow it to move axially along a portion of the shank during tightening and loosening of the jewel housing. In addition, the screw may be a hollow screw open at the end of the shank where it attaches to the jewel housing so that a culet of a jewel housed in the jewel housing can extend from the jewel housing through the receiving threaded opening in the housing into the open hollow end of the screw when the jewel housing is mounted in the jewel receiving space of the decorative setting. This allows a large jewel housed in the jewel housing to be mounted lower in the decorative setting than might otherwise be the case.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF ILLUSTRATED EXAMPLE EMBODIMENTS

The invention provides jewelry with interchangeable jewels and allows a person to change the jewels in a particular setting, such as a ring, earrings, pendant, etc., to suit the desires of the wearer. A jewel is securely housed in a jewel housing, and decorative settings, such as rings, earrings, pendants, etc., are provided having a jewel receiving space which interchangeably receives the jewel housing therein to securely mount the jewel housing with the selected jewel in the selected decorative setting. Both the jewel worn and the decorative setting worn can be selected and combined to suit the desires of the wearer.

The jewel housing is designed to securely hold the jewel therein in permanent manner meaning that a user cannot normally change the jewel in the housing. A jeweler would normally secure the selected jewel in the jewel housing and would change the jewel mounted in the housing if desired to be changed by the user. Thus, a user would select a jewel, such as a diamond, and the housing within which the jewel would be secured, such as a prong mount housing or a bezel mount housing. A jeweler would have a standard or several standard housings which could be used to securely hold the selected jewel. Alternately, the user could select from jewels already secured in housings. The user could have several jewels, each of which would be permanently secured in a jewel housing. The user would also select at least one decorative setting, such as a decorative setting in the form of a ring, to which the selected jewel can be interchangeably mounted by the user. The decorative setting will have a back side and a display side with a jewel receiving space in the display side. A fastener is adapted to attach the jewel housing with jewel therein in the jewel receiving space in the decorative setting. The fastener can be inseparably held by the decorative setting so it remains with the decorative setting while interchanging jewel housings or during storage of the decorative setting without a jewel housing mounted therein. This prevents the fastener from separating from the decorative setting and becoming lost.

Figure 1:
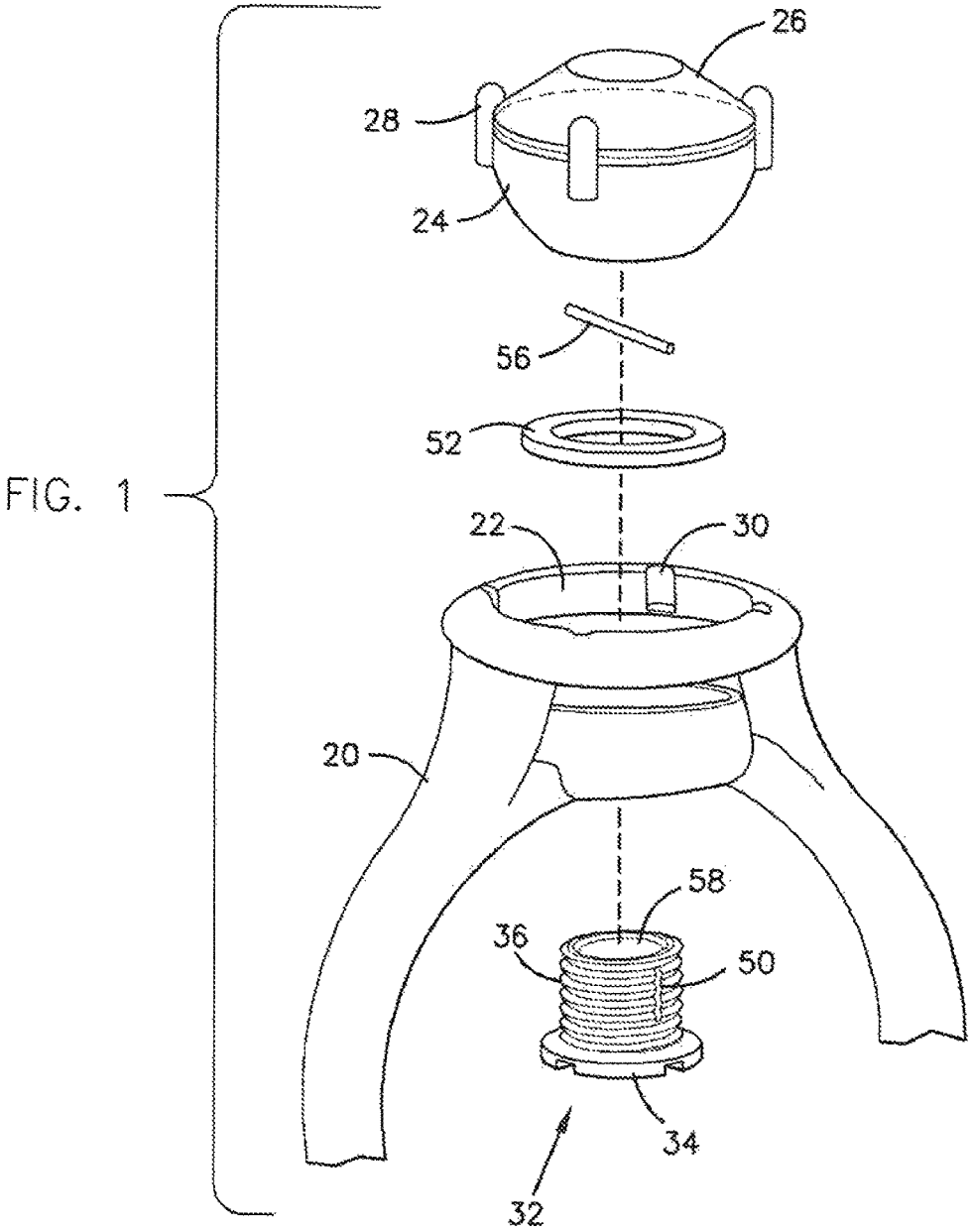
FIG. 1 is a pictorial assembly view of a decorative setting in the form of a ring, a jewel housing, and a separated screw assembly for mounting the jewel housing in the ring.
Figure 3:
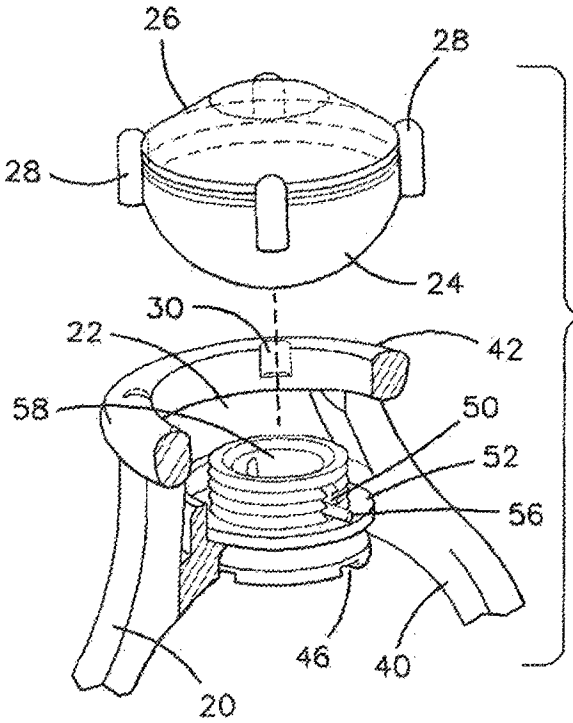
FIG. 3 is a pictorial assembly view similar to that of FIG. 1 showing a portion of the ring broken away and the screw assembly assembled and positioned in the ring.
Figure 2:
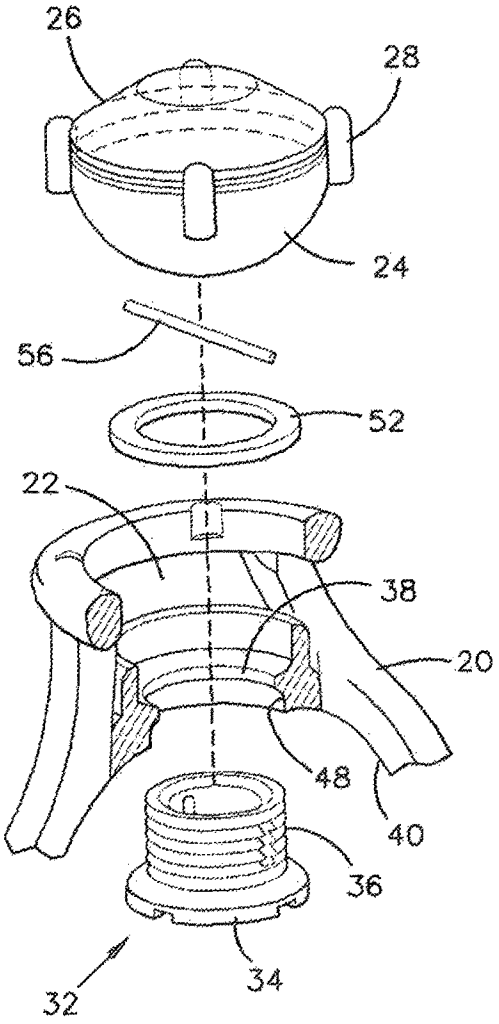
FIG. 2 is a pictorial assembly view similar to that of FIG. 1 showing a portion of the ring broken away.
Figure 5:
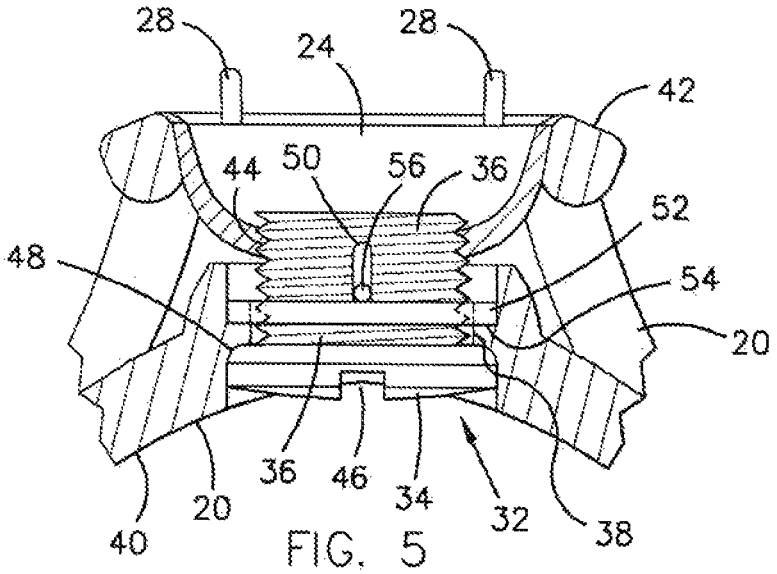
FIG. 5 is a fragmentary vertical section similar to that of FIG. 4, but showing the jewel housing attached to the ring.
Figure 6:
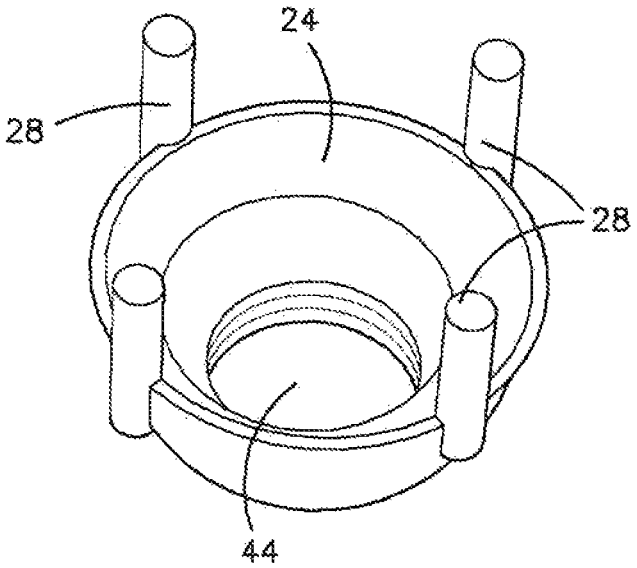
FIG. 6 is a pictorial view of a jewel housing without the jewel therein.
Figure 7:
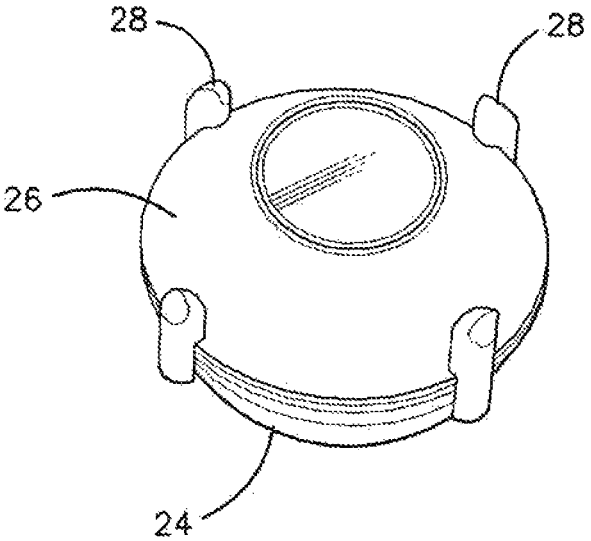
FIG. 7 is a pictorial view of the jewel housing of FIG. 6 with a jewel housed therein.

FIGS. 1-5 show a decorative setting in the form of a ring 20 having a jewel receiving space 22 therein adapted to receive a jewel housing 24 with a jewel, schematically shown in FIGS. 1-4 as 26, securely mounted in the jewel housing. FIG. 6 shows a jewel housing and FIG. 7 shows jewel housing 24 with jewel 26 held in jewel housing 24 by jewel housing prongs 28. While jewel housing 24 is illustrated as a prong mount housing, other housings, such as a bezel mount housing, can be used. The important thing is that the jewel is securely held in the jewel housing.

Figure 8:
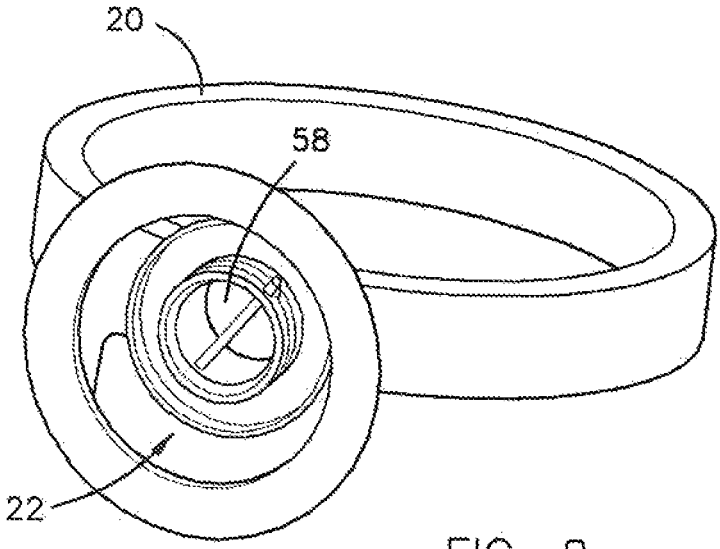
FIG. 8 is a pictorial view of a ring of the invention without a jewel.
Figure 9:
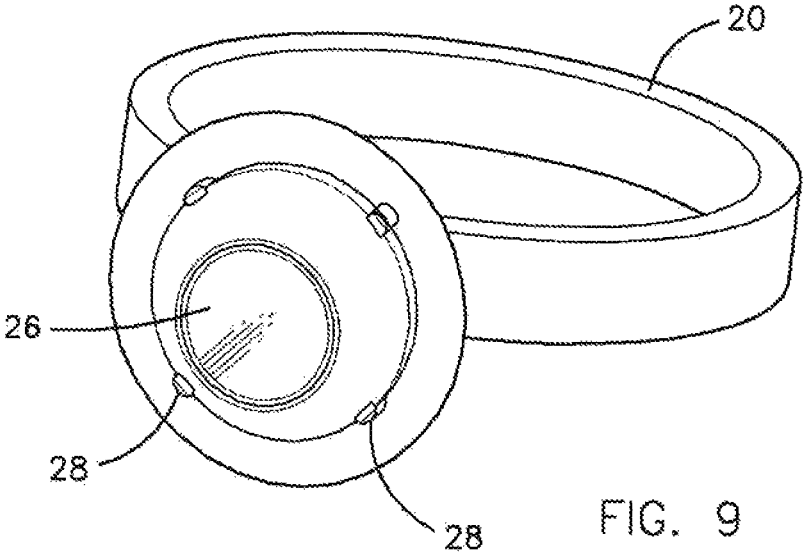
FIG. 9 is a pictorial view of the ring of FIG. 8 with a jewel therein.

To interchangeably position a jewel 26 in ring 20, jewel housing 24 is placed in jewel receiving space 22. FIGS. 1-4 show jewel housing 24 above receiving space 22 in ring 20 prior to jewel housing 24 being positioned in receiving space 22. FIG. 5 shows jewel housing 24 secured in jewel receiving space 22 in ring 20. In the embodiment shown, jewel housing 24 is interlocked in jewel receiving space 22 by jewel housing prongs 28 around the outside perimeter of jewel housing 24 projecting outwardly from the circumference of jewel housing 24 and being received by grooves 30 around the inside of jewel receiving space 22 when jewel housing 24 is inserted into jewel receiving space 22. FIG. 8 shows ring 20 without jewel housing 24 inserted in ring receiving space 22, and FIG. 9 shows ring 20 with jewel housing holding jewel 26 therein inserted into jewel receiving space 22. In the embodiment shown in FIGS. 8 and 9, jewel housing 24 is not visible when secured into receiving space 22 except for the ends of prongs 28 holding jewel 26 in jewel housing 24.

Figure 4:
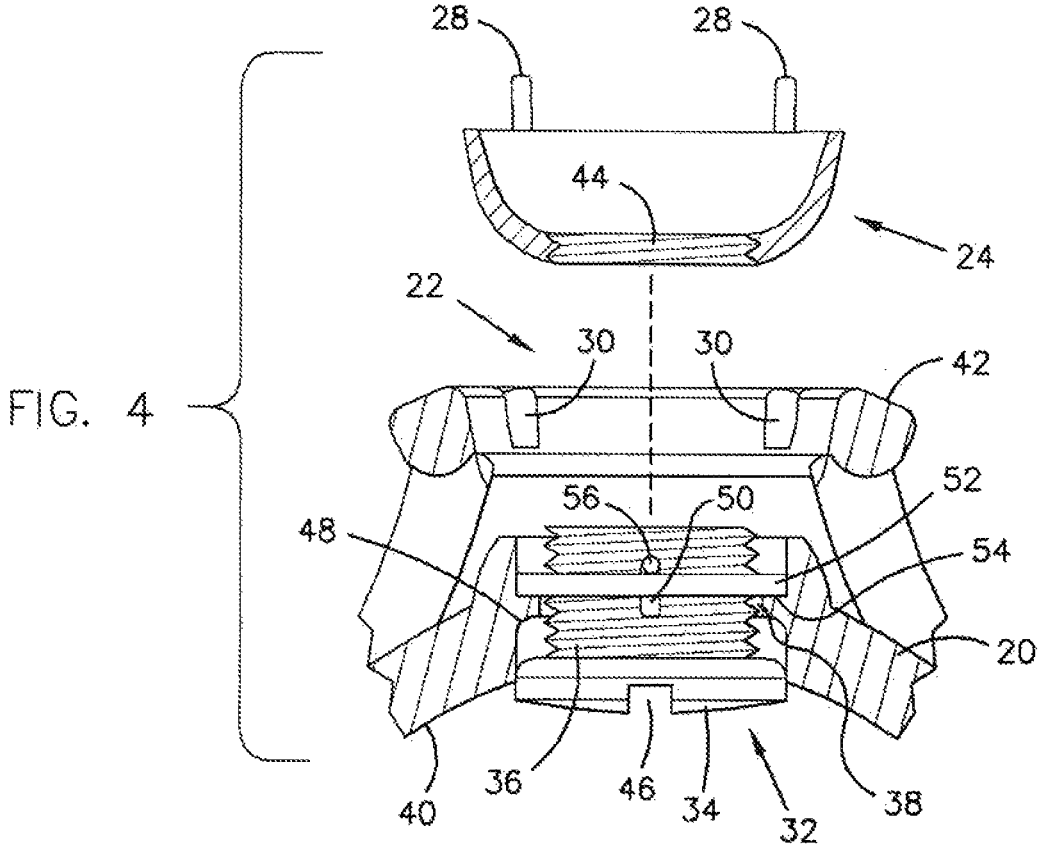
FIG. 4 is a fragmentary vertical section of the ring shown in FIG. 3 showing the screw assembly in vertical elevation and showing the jewel housing in section.
Figure 10:
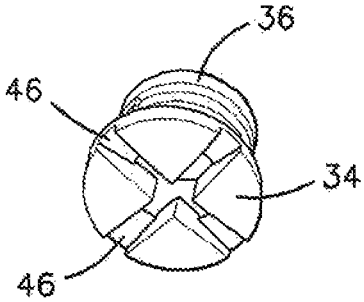
FIG. 10 is a pictorial head end view of an attachment screw used in the invention.
Figure 11:
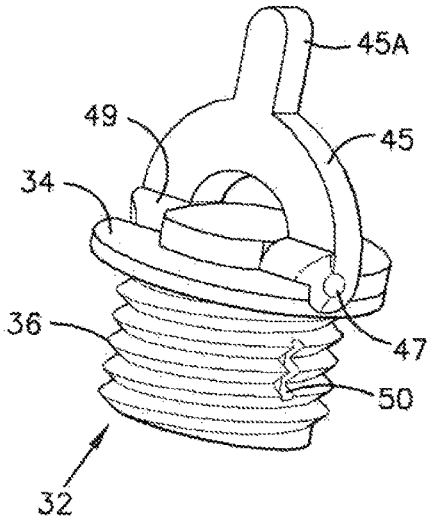
FIG. 11 is a pictorial view of another embodiment of screw used in the invention.
Figure 12:
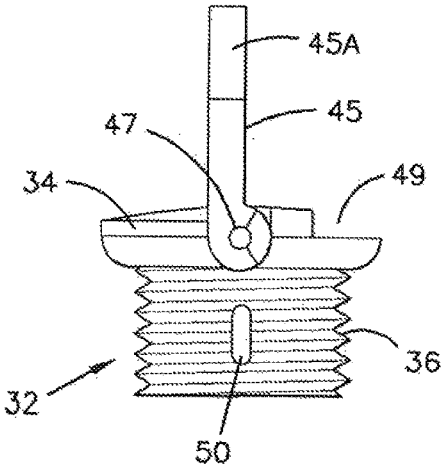
FIG. 12 is a side elevation of the screw of FIG. 11 showing a tab in extended position as shown in FIG. 11.

In the embodiment shown, a fastener in the form of a screw 32 having a head 34 and a threaded shank 36 extends freely through a fastener opening 38 which extends from the back side 40 of the decorative setting, here the inside of ring 20, to the display side 42 of the decorative setting, here the outside or front of ring 20. The shank 36 of screw 32 extends through fastener opening 38 so that a portion of shank 36 extends into jewel receiving space 22. When jewel housing 24 is positioned in jewel receiving space 22, the shank 36 of screw 32 aligns with a threaded opening 44. FIGS. 4, 5, and 6, in jewel housing 24, so that screw 32 can be screwed into threaded opening 44. Screw 32 can be turned by a user, such as by using a short screw driver which cooperates with slot or slots 46 in screw head 34, see particularly FIG. 10 which shows just the screw 32. With the two intersecting slots 46, FIG. 10, either a flat bladed or a Phillips screw driver can be used. Other heads can be used with appropriate cooperating drivers, such as a socket head with a hex key or allen wrench. In such manner, screw 32 can be tightened to securely hold jewel housing 24 in jewel receiving space 22. The interlocking grooves 30 to receive the projecting interlocking portions of jewel housing prongs 28, while not required, prevent jewel housing 24 from rotating in jewel receiving space 22 so that screw 32 can be easily tightened sufficiently to securely hold jewel housing 24 in jewel receiving space 22. The back side 40 of ring 20 includes a bevel 48 which receives screw head 34 when jewel housing 24 is received in jewel receiving space 22 and screw 32 is tightened. This prevents screw head 34 from projecting from the back side 40 of ring 20 to interfere with wearing of the ring and maintains a smooth back ring surface for comfort when a user wears the ring.

Figure 13:
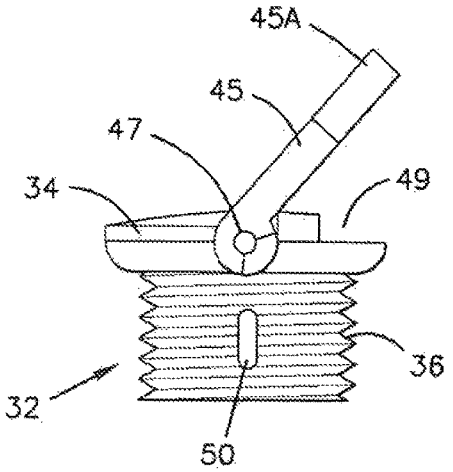
FIG. 13 is a side elevation of the screw of FIG. 11 showing the tab in partially extended position.
Figure 14:
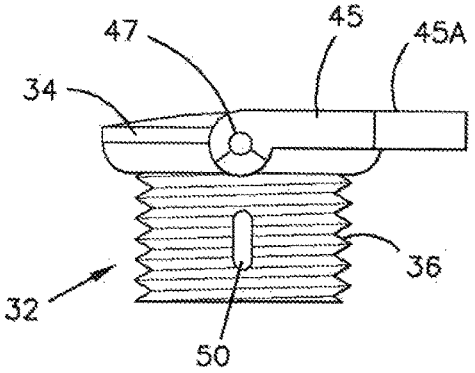
FIG. 14 a side elevation of the screw of FIG. 11 showing the tab in retracted position.

Rather than a head needing a cooperating driver which is separate from the screw 32, and could become lost, the head 34 of screw 32 can be provided with a tab 45. FIGS. 11-14, which provides a handle for a user to use to tighten or loosen screw 32. In the embodiment of FIGS. 11-14, tab 45 is pivotally attached by pin 47 to the head 34 of screw 32 so it can be rotated to an extended position, FIGS. 11 and 12, to extend axially from the screw 32, or can be rotated to a retracted position, FIG. 14, in which the tab extends radially from screw 32 and is received in a receiving opening 49 in screw head 34 to be flush with and form part of the head 34 of screw 32. Further, since in this retracted position tab portion 45A extends beyond the edge of the head 34 of screw 32 as shown in FIG. 14, a receiving recess for tab portion 45A is provided in the back side 40 of the ring to receive extending tab portion 45A when rotated to retracted position. While this is not shown for ring 20, such a receiving recess will be shown for tab portion 45A in connection with its use in the pendant embodiment and such showing and description applies for the ring embodiment also. Such a recess as will be described later can be used to hold the lab in retracted position except when needed to rotate the screw 32. Alternately, the pivot attachment and location of the attaching pin 47 in relation to tab 45 can be slightly off center such as to provide an over center rotation to retracted position which will snap tab 45 into retracted position when rotated to retracted position and maintain it in retracted position until manually rotated from retracted position. When tab 45 is used in the ring embodiment of the invention, it may be easier to use tab 45 to rotate screw 32 when tab 45 is in an intermediate extended position, such as shown in FIG. 13, which may make it easier for a user to rotate screw 32 using tab 45 when tab 45 is inside the ring linger opening, than when tab 45 is fully extended. Provision of a receiving recess for tab portion 45A keeps the screw head 34 and/or tab 45 from projecting from the back side 40 of ring 20 to interfere with wearing of the ring and maintains a smooth back ring surface for comfort when a user wears the ring.

While screw 32 is shown having traditional threads along the shank, various other types of connections and interlocks between screw 32 and jewel housing 24 can be used.

It is advantageous, and a feature of the illustrated embodiment of the invention, that the fastener, here screw 32, be inseparable from the decorative setting, here ring 20. This means that screw 32 remains attached to ring 20 when no jewel housing is in ring 20 so that it does not separate from ring 20, but remains in position to tighten and hold jewel housing 24 in jewel receiving space 22 when jewel housing 24 is to be secured to decorative setting (ring) 20. A user does not have to insert screw 32 into fastener opening 38 from inside the ring finger opening when it is desired to secure jewel housing 24 in jewel receiving space 22, which could be difficult. All that is required is that screw 32 be rotated to thread it into threaded opening 44 in jewel housing 24 and tightened when jewel housing 24 is positioned in jewel receiving space 22. Further, screw 32 cannot become separated from decorative setting (ring) 20 and become lost. In order to hold screw 32 in decorative housing (ring) 20, a slot 50 is provided extending axially along a portion of screw shank 36. Washer 52 is positioned against display side portion 54 of decorative setting 20 in jewel receiving space 22 adjacent fastener opening 38 and screw shank 36 is passed through washer 52, FIGS. 4 and 5. Wire or rod 56 is inserted through slot 50 on the side of washer 52 away from screw head 34 and away from display side portion 54 and its ends are attached, such as by laser welding, soldering, or by adhesive, to washer 52. In this way, washer 52 is secured to screw shank 36 between wire or rod 56 and display side portion 54, and washer 52 has a larger diameter than fastener opening 38, so screw 32 is locked in fastener opening 38 and inseparable from decorative setting 20. Wire or rod 56 can slide in slot 50 so screw 32 can move back and forth along fastener opening 38 a limited distance determined by the axial length of slot 50. This allows screw 32 to move up and down in jewel receiving space 22 without similar movement of washer 52 and wire or rod 56 which might interfere with tightening of jewel housing 24 in jewel receiving space 22.

For example, FIG. 4 shows screw 32 extending into jewel receiving space 22, and in the vertical orientation shown in FIG. 4, screw shank portion extends only a minimum distance into jewel receiving space 22 to provide room in jewel receiving space 22 to insert jewel housing 24 into jewel receiving space 22 substantially as far as it will normally extend. Screw 32 has not yet been screwed into jewel housing 24 so it is desirable to have the end of threaded shank 36 at a minimum extension into jewel receiving space 22 to allow maximum room to insert jewel housing 24 into jewel receiving space 22. In this position, it can be seen that screw 32 is withdrawn from jewel receiving space 22 to the maximum extend with wire or rod 56 at the end of slot 50 toward jewel receiving space 22. When jewel housing 24 is inserted into jewel receiving space 22, it will extend into jewel receiving space 22 until it is positioned as far as it can extend into jewel receiving space 22 or until the bottom of jewel housing 24 hits and abuts the end of screw 32 extending into jewel receiving space 22. Advantageously, the threaded opening 44 in the jewel housing 42 will be positioned aligned with an adjacent to or just against the end of screw 32 extending into jewel receiving space 22. Screw 32 can then be rotated to screw it into threaded opening 44 in the jewel housing 42 to thereby secure and hold jewel housing 42 in jewel receiving space 22, as shown in FIG. 5. It can be seen from FIG. 5 that this process draws the end of screw 32 into jewel receiving space 22 while keeping washer 52 and wire or rod 56 at the end of jewel receiving space 22, i.e., screw 32 is drawn through washer 52, thereby causing wire or rod 56 to slide along slot 50 toward its end away from jewel housing 42 as can be seen in FIG. 5. This arrangement of washer 52 and wire or rod 56 passing through axial slot 50 in screw 32 allows screw 32 to move longitudinally with respect to washer 52 into and out of jewel receiving space 22 and jewel housing 24. It also acts to prevent removal of screw 32 from ring 20.

While screw 32 may be inseparable from the decorative setting for purposes of the invention so that it cannot easily be separated from the decorative setting by a user, if screw 32, washer 52, or wire or rod 56 become damaged or corroded, the user, or generally a jeweler, can unsolder the ends of wire or rod 56, or cut wire or rod 56, so can then separate screw 32 from decorative setting 20 and replace screw 32 and/or washer 52 along with wire or rod 56, as needed. This does not make screw 32 separable from decorative setting 20 for purposes of this invention. It should be noted that if screw 32, washer 52, and wire or rod 56 are made of precious metal along with the decorative setting, such as from gold, silver, or platinum, these parts will resist corrosion and generally will not become damaged and need to be replaced.

Screw 32 may be a hollow screw, as shown, meaning that the inside of screw 32, at least at the end portion thereof, is hollow as at 58, FIGS. 1, 2, 3, and 15. This is advantageous to allow the jewel 26 in the jewel housing 24 to sit as low as possible. In some instances, such as when a large jewel is housed in jewel housing 24, the culet 59, FIG. 15, of the jewel 26 held in the jewel housing 24 can extend into, or even through, threaded opening 44 of jewel housing 24. If the end of screw 32 is solid, this can limit the distance a screw 32 can be screwed into threaded opening 44 thus limiting the distance jewel housing 24 can be drawn into jewel receiving space 22, or can even prevent screw 32 from being received in threaded opening 44 of jewel housing 24. With a hollow screw end portion 58, when screw 32 is screwed into threaded opening 44 of jewel housing 24, the culet 59 of jewel 26, if it extends into threaded opening 44 of jewel housing 24, can extend into the hollow screw end portion 58. Further, in addition to providing hollow Screw end portion 58, wire or rod 56 can be configured with a center portion 60, FIG. 15, which extends through hollow screw end portion 58, bent therein away from the screw end, again to accommodate the culet 59 of a jewel 26 held in the jewel housing.

Figure 18:
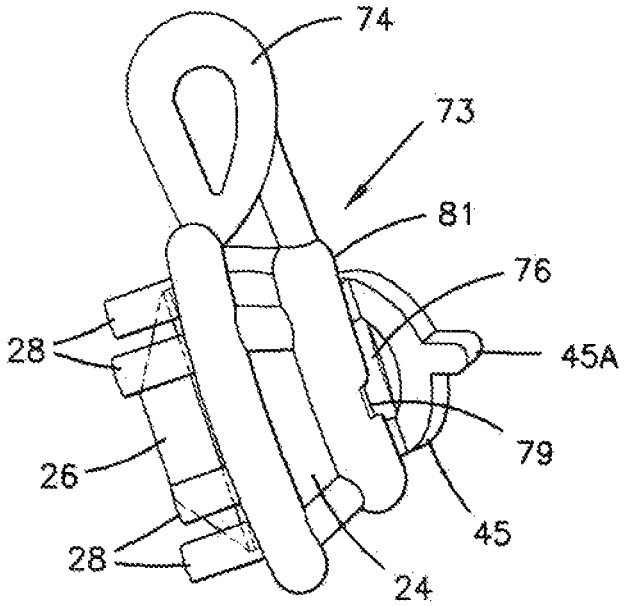
FIG. 18 is a side elevation of another embodiment of a decorative setting in the form of a pendant assembled with a jewel housing therein.
Figure 19:
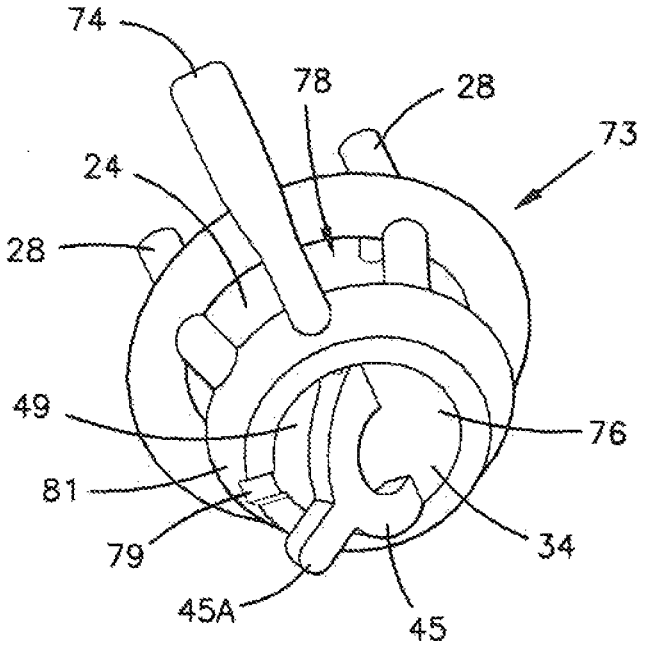
FIG. 19 is a pictorial back top view of the pendant of FIG. 18.

With the decorative setting in the form of a ring 20 as shown in FIGS. 1-5 and described above, a user can selectively interchange the jewels which are mounted in and displayed by the ring as desired by the user, or can selectively interchange the particular ring used with a particular jewel. The invention is not limited to a decorative setting in the form of a ring. A wide variety of other jewelry items, such as earrings, pendants, necklaces, bracelets, pins, cuff links, etc., can be used with the invention. For example, the invention can be used in connection with earrings as shown in FIG. 16 or with pendants as shown in FIGS. 17, 18, and 19.

Figure 16:
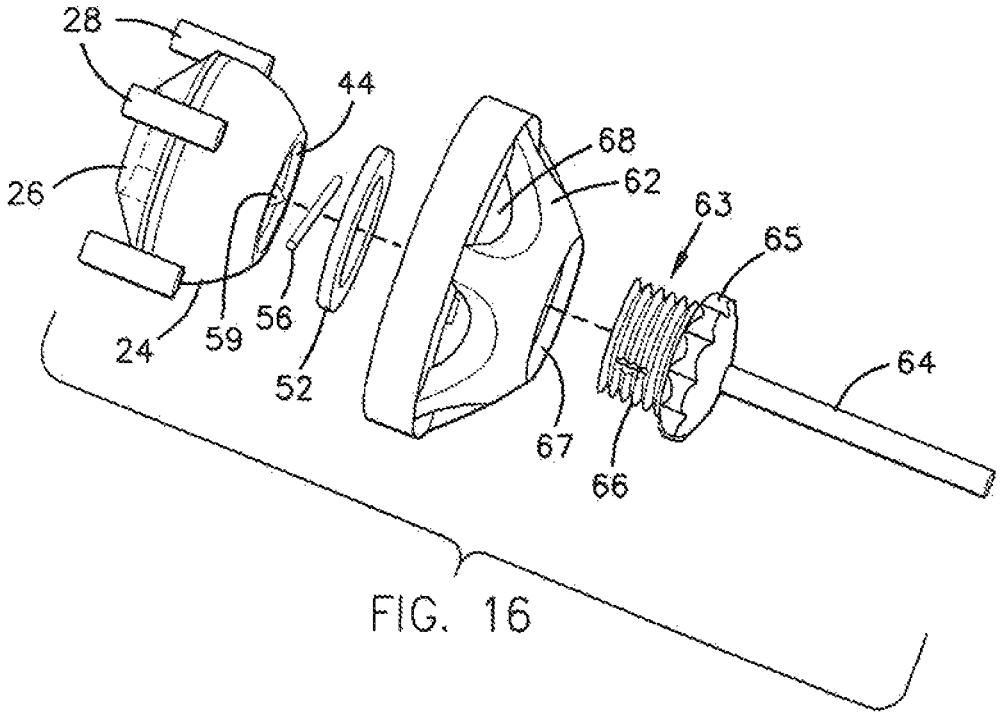
FIG. 16 is a pictorial assembly view of a decorative setting in the form of an earring, a jewel housing, and a separated screw assembly for mounting the jewel housing in the earring.

As shown in FIG. 16, the decorative setting 62 of the invention takes the form of an earring. A screw 63 has an earring post 64 attached to the screw head 65 and extending therefrom. The mounting of the screw 63 in decorative setting (earring) 62 and its operation in attaching jewel housing 24 in decorative setting 62 is as previously described for a decorative setting in the form of a ring. Thus, threaded shank 66 of screw 65 will extend through fastener opening 67 through decorative setting (earring) 62, into jewel receiving space 68. Screw 63 will be attached to decorative setting (earring) 62 with washer 52 and wire or rod 56 as previously described for ring 20. Screw head 65 is shown as knurled to be easily rotated by a user's fingers. Jewel 26 in jewel housing 24 is secured to decorative setting (earring) 62 by positioning jewel housing 24 in jewel receiving space 68 and rotating screw 63 to screw it into threaded opening 44 in jewel housing 24 as described for the ring 20. Again, jewel culet 59 can be received in an open hollow end portion of screw 63. Decorative setting (earring) 62 may have grooves around the inside circumference thereof to interlock with prongs 28 as for the ring, or, since with the earrings the jewel housing 24 and the knurled screw head 65 are both readily accessible to and can be held and manipulated by a user, the jewel receiving space may have an inside circumference large enough to receive the jewel housing without providing the grooves to receive and hold the portion of the prongs 28 which extend into the jewel receiving space 68. In this case the jewel housing 24 is free to rotate in jewel receiving space 68, but can be held by the user to prevent it from rotating during tightening of screw 63.

Figure 17:
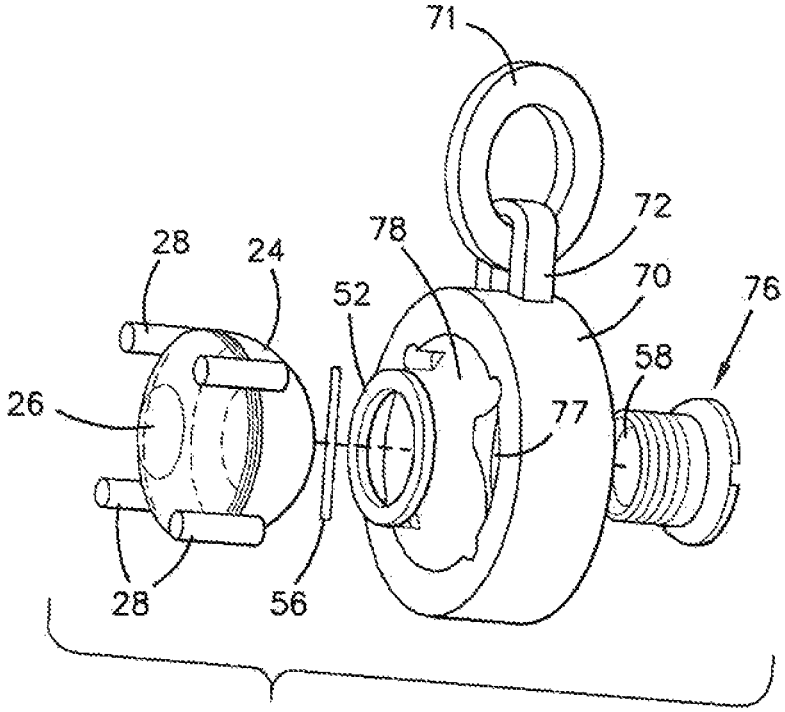
FIG. 17 is a pictorial assembly view of a decorative setting in the form of a pendant, a jewel housing, and a separated screw assembly for mounting the jewel housing in the pendant.

As shown in FIG. 17, the decorative setting 70 of the invention takes the form of a pendant. The pendant 70 has a connecting loop 71 connected thereto by connector 72. The pendant is worn in normal manner by passing a chain or necklace (not shown) through connecting loop 71. A second similar design embodiment of decorative setting in the form of a pendant 73 is shown in FIGS. 18 and 19. In this second design embodiment 73, a connecting loop 74 is provided for connecting to a chain or necklace. The mounting of the screw 76 through fastener opening 77 in decorative setting (pendant) 70 by washer 52 and wire or rod 56, shown in FIG. 17, and the operation of screw 76 in attaching jewel housing 24 in jewel receiving space 78, in both embodiments of pendants, is the same as previously described for the decorative setting in the form of a ring 20. FIGS. 18 and 19 show a screw 76 having a screw head 34 similar to that shown in FIGS. 11-14, with tab 45 pivotally attached to the screw bead 34 so it can be rotated to an extended position, partially extended position, or a retracted position, as described for FIGS. 11-14. In retracted position, tab 45 is received in a receiving opening 49 in screw head 34 to be flush with and form part of the bead 34 of screw 76. Further, since in this retracted position tab portion 45A extends beyond the edge of the head 34 or screw 76 similarly as shown in FIG. 14, a receiving recess 79 for tab portion 45A is provided in the back side 81 of the pendant 73 to receive extending tab portion 45A when rotated to retracted position. With both receiving opening 49 in screw head 34 and receiving recess 79 in the hack side 81 of the pendant 73, for receiving tab portion 45A, tab 45 will provide a substantially smooth back side for pendant 73 when in retracted position. Receiving recess 79 is shown in fixed position in the back of pendant 73. Since screws 76 and threaded openings in jewel housings 24 will be generally standardized, the location of receiving recess 79 can be determined to receive tab portion 45A when substantially in a tightened condition holding jewel housing 24 in the pendant jewel receiving space 78. If deemed necessary or desirable, several receiving recesses 79 can be provided around the back of pendant 73 providing a choice of which one to use in a particular situation for tightness of screw 76. Further, receiving recess 79 can be sized to hold tab portion 45A in receiving recess 79 when tab 45A is pushed into receiving recess 79 by a user so that it will remain in the recess until manually pulled out by a user. For example, the width of receiving recess 79 can be size to tightly and frictionally hold the sides of tab portion 45A, or the width between top edges of the receiving recess can provide a tight entrance to receiving recess 79 which will hold tab portion 45A therein. Alternately, as described above, the pivot attachment and location of the attaching pin 47 in relation to tab 45 can be slightly off center such as to provide an over center rotation to retracted position which will snap tab 45 into retracted position when rotated to retracted position and maintain it in retracted position until manually rotated from retracted position. Also as previously indicated, a similar receiving recess or recesses to receive tab portion 45A can be provided in rings of the invention or other decorative settings of the invention.

Figure 20:
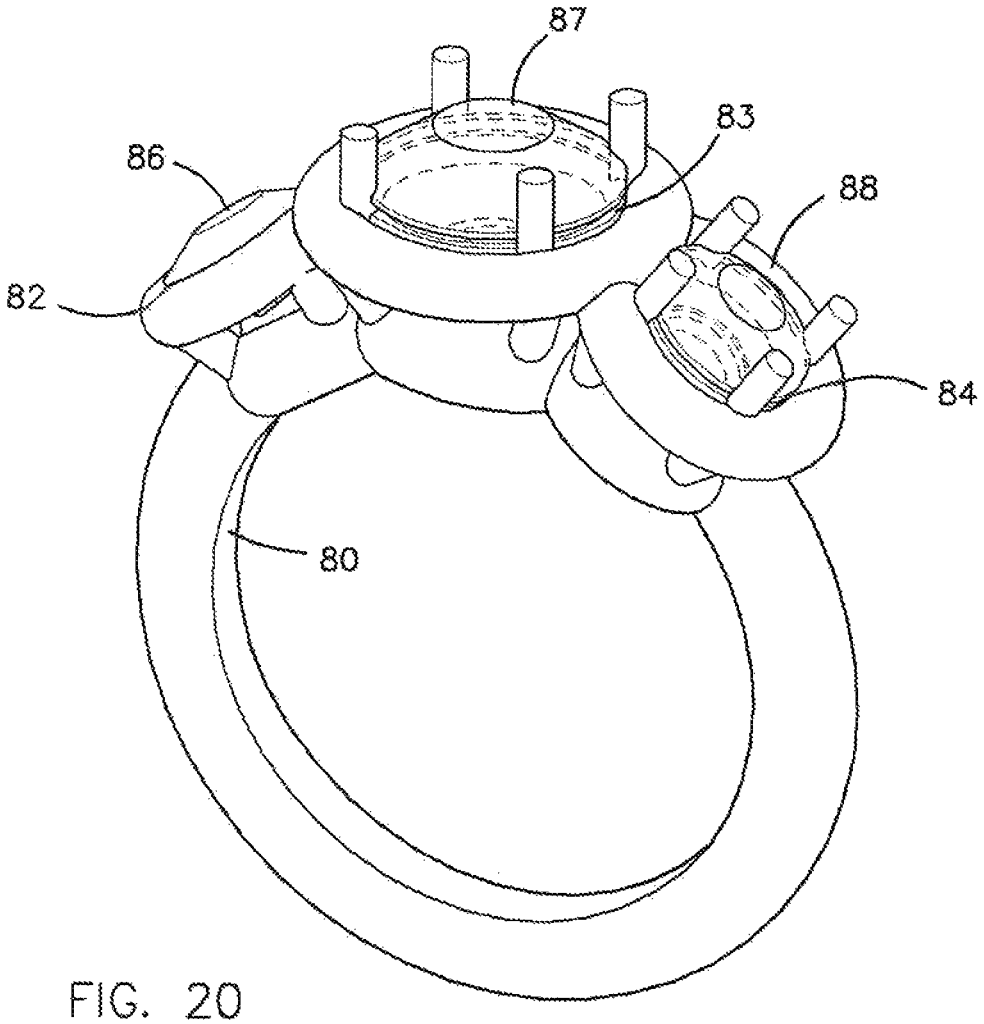
FIG. 20 is a pictorial top side view of a decorative setting in the form of a ring having three jewel receiving spaces therein with three jewel housings with jewels therein mounted on the ring.
Figure 15:
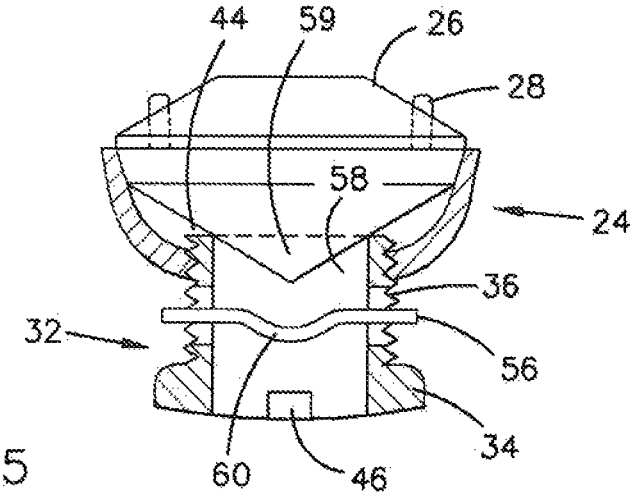
FIG. 15 is vertical section of a screw of the invention screwed into a jewel housing with jewel therein.

While the embodiments illustrated so far show decorative settings which attach a single jewel housing 24, decorative settings can be provided which attach multiple jewel housings 24. FIG. 20 shows a decorative setting 80 in the form of a ring having three jewel receiving spaces 82, 83, and 84 to attach three separate jewel housings with jewels 86, 87, and 88 therein. It should also be realized that jewel housings 24 can be provided to hold multiple jewels therein rather than just a single large jewel.

The jewel housings can be made in several standard diameters and shapes to be received in jewel receiving spaces of similar receiving sizes and shapes. Various decorative settings can be provided with the same particular size and shape jewel receiving spaces to receive and mount jewels in housing of that particular size and shape. In this way, a variety of jewels in a particular size and shape jewel housing can be interchangeably mounted into a variety of decorative settings.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A jewelry device adapted to have interchangeable jewels, comprising:

a decorative setting for displaying a jewel, said decorative setting having a jewel receiving space in a decorative display side and having a back side;

a fastener opening extending between the jewel receiving space and the back side;

a fastener inseparably held by the decorative setting adapted to attach to and hold a jewel housing having a jewel secured therein when the jewel housing is inserted into the jewel receiving space on the display side of the decorative setting, said fastener having a head larger than the fastener opening and a shank with the shank passing through the fastener opening into the jewel receiving space and the head remaining on the back side; and a flange slidably attached to a portion of the shank in the jewel receiving space, said flange being larger than the fastener opening to thereby hold the fastener attached to the decorative setting while allowing the fastener limited sliding movement with respect to the flange and the jewel receiving space.

2. A jewelry device adapted to have interchangeable jewels according to claim 1, additionally including a jewel housing having a jewel secured therein and having an opening to receive the fastener therein when the jewel housing is received in the jewel receiving space in the decorative setting.

3. A jewelry device adapted to have interchangeable jewels according to claim 2, wherein the fastener head includes a retractable tab for helping a user attach the fastener into the opening in the jewel housing.

4. A jewelry device adapted to have interchangeable jewels according to claim 1, wherein the decorative setting is in the form of a ring.

5. A jewelry device adapted to have interchangeable jewels according to claim 1, wherein the decorative setting is in the form of an earring.

6. A jewelry device adapted to have interchangeable jewels according to claim 1, wherein the decorative setting is in the form of a pendant.

7. A jewelry device adapted to have interchangeable jewels according to claim 1, wherein the decorative display back side includes a bevel for receiving the fastener head.

8. A jewelry device adapted to have interchangeable jewels according to claim 1, wherein the fastener has a hollow end.

9. A jewelry device adapted to have interchangeable jewels, comprising:

a decorative setting for displaying a jewel, said decorative setting having a jewel receiving space in a decorative display side and having a back side;

a fastener opening extending between the jewel receiving space and the back side of the decorative setting;

a fastener inseparably held by the decorative setting adapted to attach to and hold a jewel housing having a jewel secured therein when the jewel housing is inserted into the jewel receiving space on the display side of the decorative setting, said fastener comprising a screw having a head and a shank with the shank passing through the fastener opening into the jewel receiving space and the head remaining on the back side;

a flange attached to a portion of the shank in the jewel receiving space, said flange being larger than the fastener opening to thereby hold the screw attached to the decorative setting;

wherein the shank includes a slot through a portion thereof in the jewel receiving space, and wherein the flange includes a washer through which the shank passes, and a pin extending through the slot and attached to the washer to prevent the washer from separating from the screw.

10. A jewelry device adapted to have interchangeable jewels according to claim 9, wherein the decorative display back side includes a bevel for receiving the screw head.

11. A jewelry device adapted to have interchangeable jewels according to claim 9, wherein the slot extends axially along the shank to allow the pin and attached washer to slide axially along the shank and the shank to slide a limited distance in the fastener opening.

12. A jewelry device adapted to have interchangeable jewels according to claim 11, wherein the decorative setting includes an interlock for interlocking with a jewel housing when the jewel housing is received in the jewel receiving opening to prevent relative motion of the jewel housing with respect to the decorative setting.

13. A jewelry device adapted to have interchangeable jewels according to claim 12, wherein the interlock includes a groove in the jewel receiving space.

14. A jewelry device adapted to have interchangeable jewels according to claim 13, additionally including a jewel housing having a jewel secured therein and having a threaded opening to receive the screw therein when the jewel housing is received in the jewel receiving space in the decorative setting.

15. A jewelry device adapted to have interchangeable jewels according to claim 14, wherein the jewel housing includes a projection adapted to cooperate with the groove in the jewel receiving space to prevent rotation of the jewel housing with respect to the decorative display when the jewel housing is secured to the decorative setting.

16. A jewelry device adapted to have interchangeable jewels according to claim 14, wherein the screw has a hollow end.

17. A jewelry device adapted to have interchangeable jewels according to claim 14, wherein the screw head includes a retractable tab for helping a user screw the screw into the threaded opening in the jewel housing.

18. A jewelry device adapted to have interchangeable jewels, comprising:

a decorative setting for displaying a jewel having a jewel display side and a back side with an opening extending between the jewel display side and the back side;

a screw having a head and a shank with the shank passing through the opening with the head remaining on the back side;

a flange slidably attached to a portion of the shank extending through the opening to the display side and allowing the fastener limited sliding movement with respect to the flange and the jewel receiving space;

wherein the flange on the display side of the setting and the screw head on the back side of the setting keep the screw coupled to the setting, and the shank extending through the opening to the display side is adapted to screw into and hold a jewel housing having a jewel secured therein on the display side.

19. A jewelry device adapted to have interchangeable jewels according to claim 18, additionally including a jewel housing having a jewel secured therein and having a threaded opening to receive the screw therein when the jewel housing is received in the jewel receiving space in the decorative setting.

* * * * *